US005113665A

United States Patent [19]

Katsuki

[11] Patent Number: 5,113,665

[45] Date of Patent: May 19, 1992

[54] CONTROL DEVICE FOR AIR CONDITIONER

[75] Inventor: Hikaru Katsuki, Gunma, Japan

[73] Assignee: Sanyo Electric Company, Ltd., Osaka, Japan

[21] Appl. No.: 695,342

[22] Filed: May 6, 1991

[30] Foreign Application Priority Data

May 29, 1990 [JP] Japan ..... 2-141149

[51] Int. Cl.[5] ..... F25B 49/00

[52] U.S. Cl. ..... 62/126; 236/51; 236/94

[58] Field of Search ..... 236/51, 94; 62/125, 62/126

*Primary Examiner*—William E. Wayner

*Attorney, Agent, or Firm*—Wenderoth, Lind & Ponack

[57] ABSTRACT

A control device for an air conditioner can prevent an erroneous operation in the starting and ending of a test run. The control device can start the test run of the air conditioner through the operation of a switching device after electrical power is supplied to the control device, and can end the test run when the operation data is received from a remote controller.

2 Claims, 4 Drawing Sheets

CONTROL DEVICE FOR AIR CONDITIONER

BACKGROUND OF THE INVENTION

The present invention relates in general to a control device for operating a test run of an air conditioner and, more particularly, to the control device for an air conditioner which can suppress erroneous operation during the actions of starting and ending of the test run.

As the conventional technique of starting and ending of the test run for an air conditioner, a useful device is shown in Japanese Patent Publication No. 63-12,223/1988. This conventional device has a discriminating-comparing means for controlling the room temperature, a test run input means for receiving an input of data for forcibly running a compressor, an input device for receiving data for switching the states of operation, a controller for controlling the air conditioner in response to data from the abovenoted respective devices, and a control means for operating the air conditioner in response to a signal from this controller. The controller has a device for forcibly running the compressor in response to an input from the test running input means and a device for releasing the forced running of the compressor in response to an input from the test run means during the forced running or an input from the input means. With this arrangement, the test run can be released by either the test run input means or the input device.

With the conventional device described above, however, when an ending operation of the test run is performed by means of the input device, the test run input means is still left set on the test run and consequently it is likely that a user becomes dubious and then takes an unnecessary operation after all. When a room unit of the air conditioner is installed at a relatively high position in a room, it is quite difficult to operate the test run input means. Furthermore, on erroneous test run is possibly performed so often by an erroneous operation of the user since the test run in the conventional device is easily started through the easy operation of the test run input means.

SUMMARY OF THE INVENTION

An object of the present invention is to provide an improvement in the control device for the air conditioner, which can prevent an erroneous operation in starting and/or ending of a test run.

Another object of the present invention is to provide an improved control device for operating a test run of an air conditioner, which is capable of suppressing forgotten ending and mistaken operation with respect to the test run.

The present invention provides a control device for operating a test run of an air conditioner, with a wireless remote controller for transmitting operating data to the air conditioner, a having a receiving circuit for receiving the operating data, switching means having at least two switching positions, a microprocessor for operating the air conditioner in response to the operating data received by the receiving circuit, and a power source for supplying electrical power to the microprocessor, the microprocessor scanning a position of the switching means and thereafter inputting the operating data from the receiving circuit during the time when electrical power is supplied to the microprocessor.

The microprocessor comprises:

a first means for starting an operation of the air conditioner in response to the operating data when the switching means is in a first position;

a second means for maintaining the operation of the air conditioner in a forced stopping state so as to ignore the operating data when the switching means is in a second position;

a third means for starting the test run of the air conditioner when the switching means is first changed from the second position to the first position, after the switching means is placed in the second position thereof by an initial and effective scanning of the microprocessor; and a fourth means for changing from the test run and carrying out the operation of the air conditioner in response to the operating data when the receiving circuit receives the operating data from the wireless remote controller during the test run of the air conditioner.

In addition, when the switching means is changed from the first position to the second position after scanning, the microprocessor can end the test run.

In the present invention, the control device can start the test run of the air conditioner through the operation of the switching means after electrical power is supplied to the control device, and can end the test run when the operating data is received from the remote controller.

PREFERRED EMBODIMENT OF THE INVENTION

A preferred embodiment of the invention will be described with reference to a separate type-air conditioner having an indoor unit and an outdoor unit. For the purpose of simplification and clarification, the explanation will be given for a cooling operation and the same effect can be obtained by the air conditioner for both the heating and cooling operation.

Figure 1:
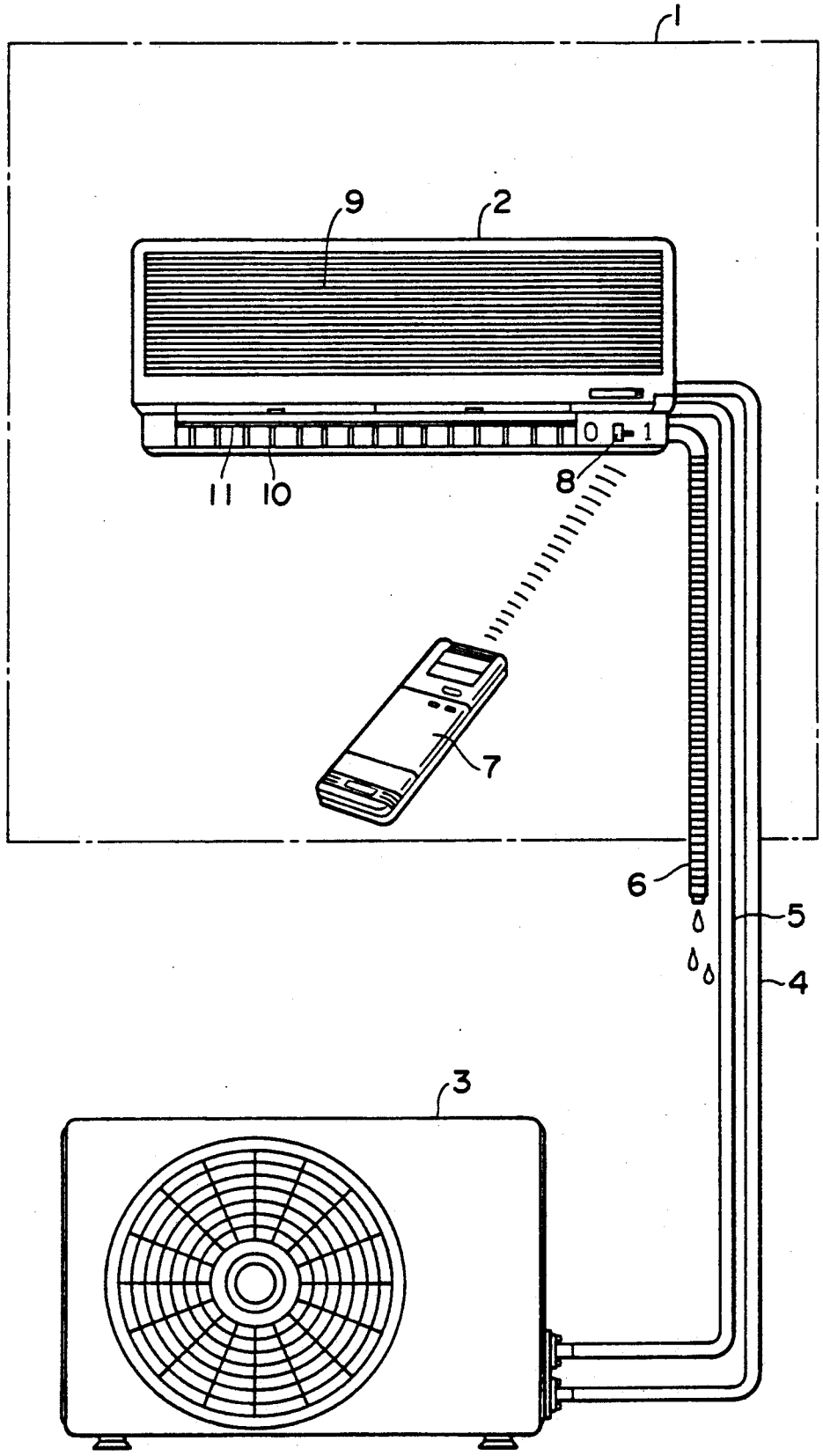
FIG. 1 is a diagram illustrating the air conditioner according to the present invention, showing an indoor unit and an outdoor unit.

In FIG. 1, a room unit 2 is secured on the wall at a high position adjacent to a ceiling of a room 1. An outdoor unit 3 provided outside the room is connected to an indoor unit by refrigerant pipings 4 and 5 and a signal line. A drain hose 6 is used for discharging the drainage produced by an indoor heat exchanger during the cooling operation out of the room. A remote controller 7 for outputting a wireless signal, which outputs the predetermined operating data by the key operation. A switch 8 is selectively set in either a position "1" (first position) or a position "0" (second position). Air drawn in from an air intake 9 is cooled in a heat exchanger on the inside and supplied into the room through an air outlet 10. A flap 11 is adapted to change the discharge direction of the conditioned air discharged from the air outlet 10.

With the air conditioner having the above arrangement, when operation data is output by the operation of a remote controller, this operation data is input into a controller of the indoor unit 2 and the air conditioner is controlled in response to this operation data.

Figure 2:
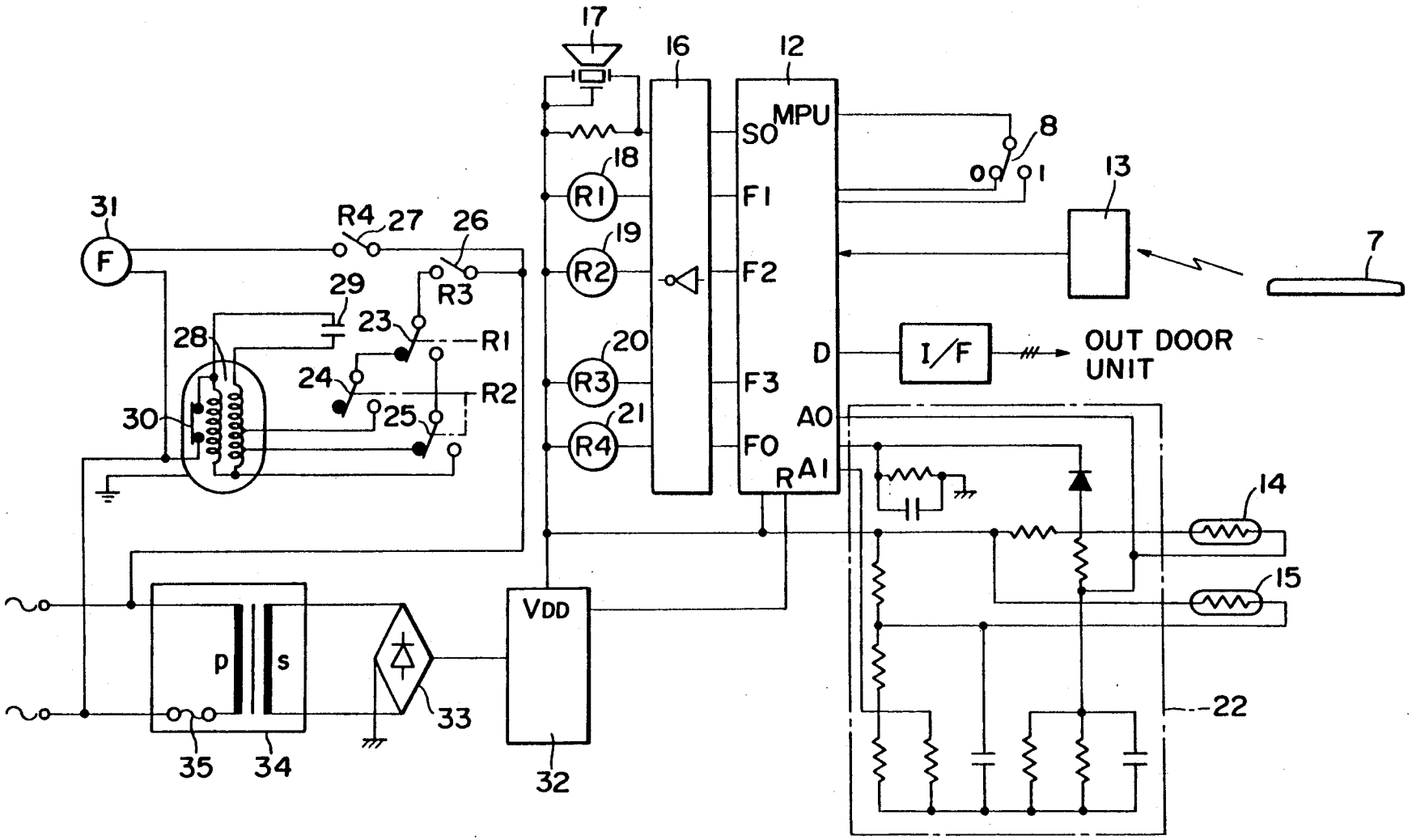
FIG. 2 is an electrical circuit diagram showing an example of an indoor controller in the indoor unit shown in FIG. 1.
Figure 3:
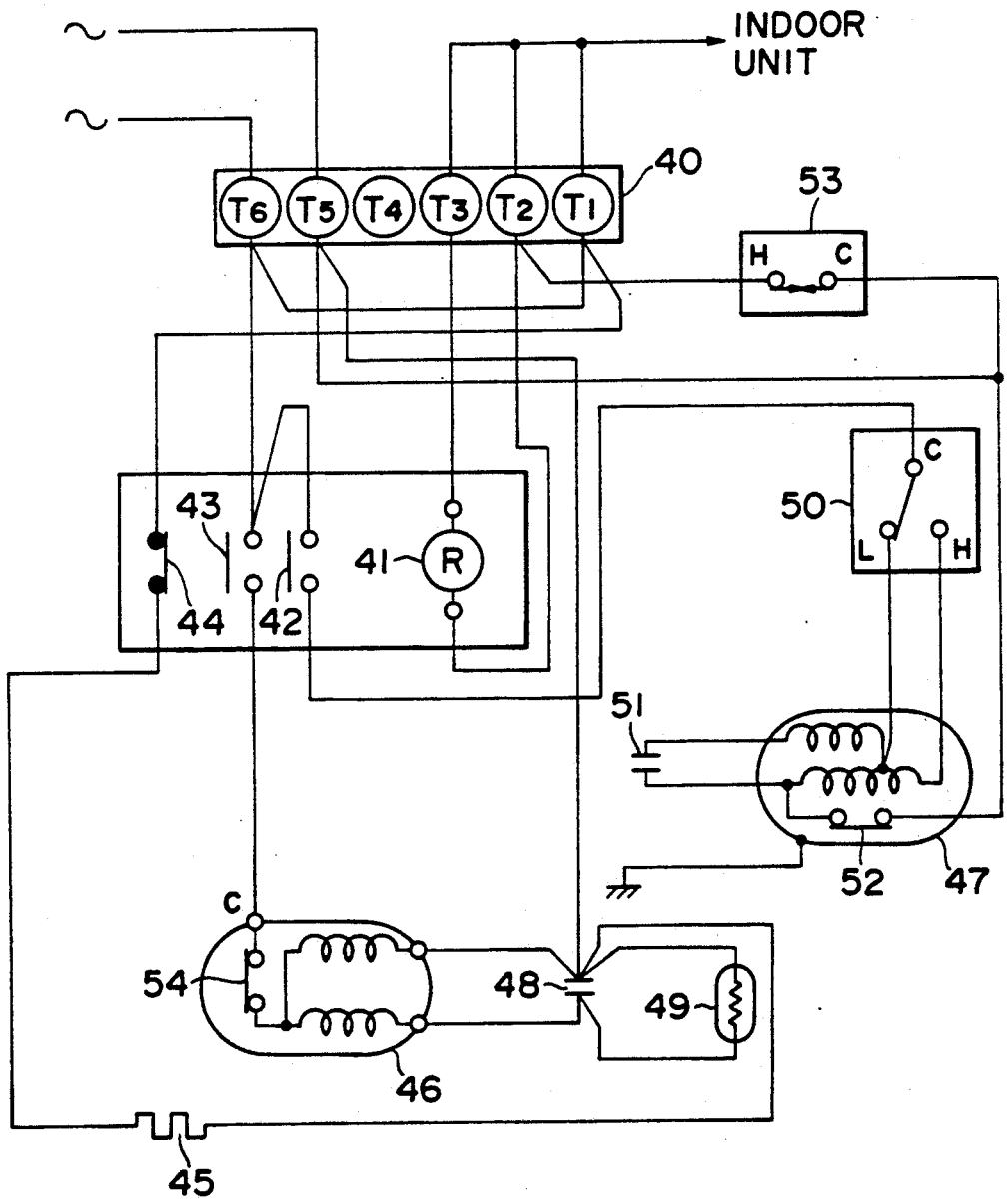
FIG. 3 is an electrical circuit diagram showing an example of an outdoor controller in the outdoor unit shown in FIG. 1.

FIG. 2 shows an indoor controller which constitutes a controller of the air conditioner with an outdoor controller as shown in FIG. 3. In FIG. 2, a microprocessor 12 determines whether the switch 8 is in the position "0" or the position "1" by scanning, and receives an input of the operating data transmitted from the remote controller 7 via a receiving circuit 13 and receives an input of the room temperature detected by a temperature sensor 14 and the temperature of the indoor heat exchanger detected by a temperature sensor 15, to thereby operate the air conditioner. In these temperature sensors 14 and 15, the temperatures are transduced to voltage values corresponding to the detected temperatures by a temperature/voltage transducing circuit 22. This voltage is applied to analog input terminals A0 and A1 of the microprocessor 12. In the microprocessor 12, the voltage applied to the terminals A0 and A1 is A/D converted to be stored in a storage section as the temperature values.

A driver circuit 16 amplifies the power of an output from the microprocessor 12 to control current conducting of a sounding body 17 (piezoelectric loudspeaker and the like) and relays 18–21.

The sounding body 17 emits a sound signal at the time of receiving an input of the operating data transmitted from the remote controller 7, identifying the operation of the switch 8 and so forth.

The relay 18 has a change-over contactor 23, and the relay 19 has change-over contactors 24 and 25. The relay 20 has a normally opened contactor 26 and the relay 21 has a normally opened contactor 27. FIG. 2 shows the states of the respective contactors, in which the relays 18–21 are in the states of no current conduction, i.e. the states where the microprocessor 12 supplies no output. A single phase induction motor 28 for blowing air has four stages of air speeds including an air stop, breeze, medium and strong according to the opening or closing of the normally opened contactor 26 and the positions of the change-over contactors 24, 25. This air speed change-over is performed by changing the connection of an intermediate terminal of the winding of a stator of the motor. Reference numeral 29 designates an operating capacitor and reference numeral 30 designates a temperature relay for opening a contactor when the temperature of the motor is abnormally high. The motor 28 drives a cross flow fan for discharging the conditioned air which is cooled by the indoor heat exchanger through the air outlet 10.

A motor 31 for the flap is operated by closing the normally opened contactor 27. Driving of the motor makes it possible to drive the flap 11 provided in the air outlet 10 and changes the angle (discharging direction of the conditioned air) of the flap 11. When this motor is continuously operated, the angle of the flap 11 is continuously changed so that the conditioned air can be diffused over the whole room to be air-conditioned.

A power source 32 regulates the DC power rectified by a rectifying circuit 33 and supplies outputs of a DC voltage for driving the microprocessor 12, sounding body 17, relays 18–21 and so forth. The power source 32 supplies a power-ON signal to a terminal R of the microprocessor 12 to reset the microprocessor 12. The power-ON signal is output when the output voltage from the power source 32 exceeds 85–90% of the rated voltage (mainly, the rated voltage of the microprocessor 12).

A stepdown transformer 34 steps down the AC voltage from an AC power source to a predetermined voltage. A temperature fuse 35 is melted to cut off the supply of power from the AC power source when the temperature of the stepdown transformer 34 exceeds a predetermined temperature.

FIG. 3 shows an outdoor controller provided in an outdoor unit, which is connected to a terminal D of the microprocessor 12 of the indoor controller shown in FIG. 2 through three signal lines and an interface I/F. In a terminal strip 40, terminals $T_1$–$T_3$ are connected to signal lines from the microprocessor 12, and terminals $T_5$ and $T_6$ are connected to a single-phase AC power source. An auxiliary relay 41 has normally opened contactors 42 and 43 and a normally closed contactor 44. FIG. 3 shows a state where no current is supplied to the relay 41. The normally opened contactor 44 is closed, whereby current is passed through a crankcase heater 45. Next, when current is supplied to the relay 41 in response to a signal from the microprocessor 12 of the indoor controller, the normally closed contactor 44 is opened and the normally opened contactors 42 and 43 are closed. When the normally opened contactors 42 and 43 are closed, current is supplied to a compressor 46 and a single phase induction motor 47 for an outdoor blower.

The compressor 46 uses a single phase induction motor. Reference numeral 48 designates a capacitor for the operation, which is connected to a positive characteristic thermistor 49 having such characteristics that the resistance value is lowered at the start of the compressor operation. A thermal protector 50 opens a contactor when the temperature of the compressor 46 is abnormally high. The motor 47 has speed adjusting terminals of two speeds including H (high speed rotation) and L (low speed rotation), which can be automatically switched in accordance with the outdoor temperature detected by the thermal protector 50. Namely, when the outdoor temperature is high, the high speed rotation is adopted and, when the outdoor temperature is low, the low speed rotation is adopted. The motor 47 has a capacitor 51 for the operation and a thermal protector 52 for opening a contactor when the temperature of the motor is abnormally high. A pressure switch 53 opens a normally closed contactor when the refrigerant discharge pressure of the compressor 46 is abnormally high. The microprocessor 12 of the indoor controller detects opening or closing of the switch 53 from changes in voltage of the terminals $T_1$ and $T_2$ to stop the air conditioner into the stop. When the contactor of the pressure switch 53 is closed, the air conditioner starts the normal operation again.

Figure 4:
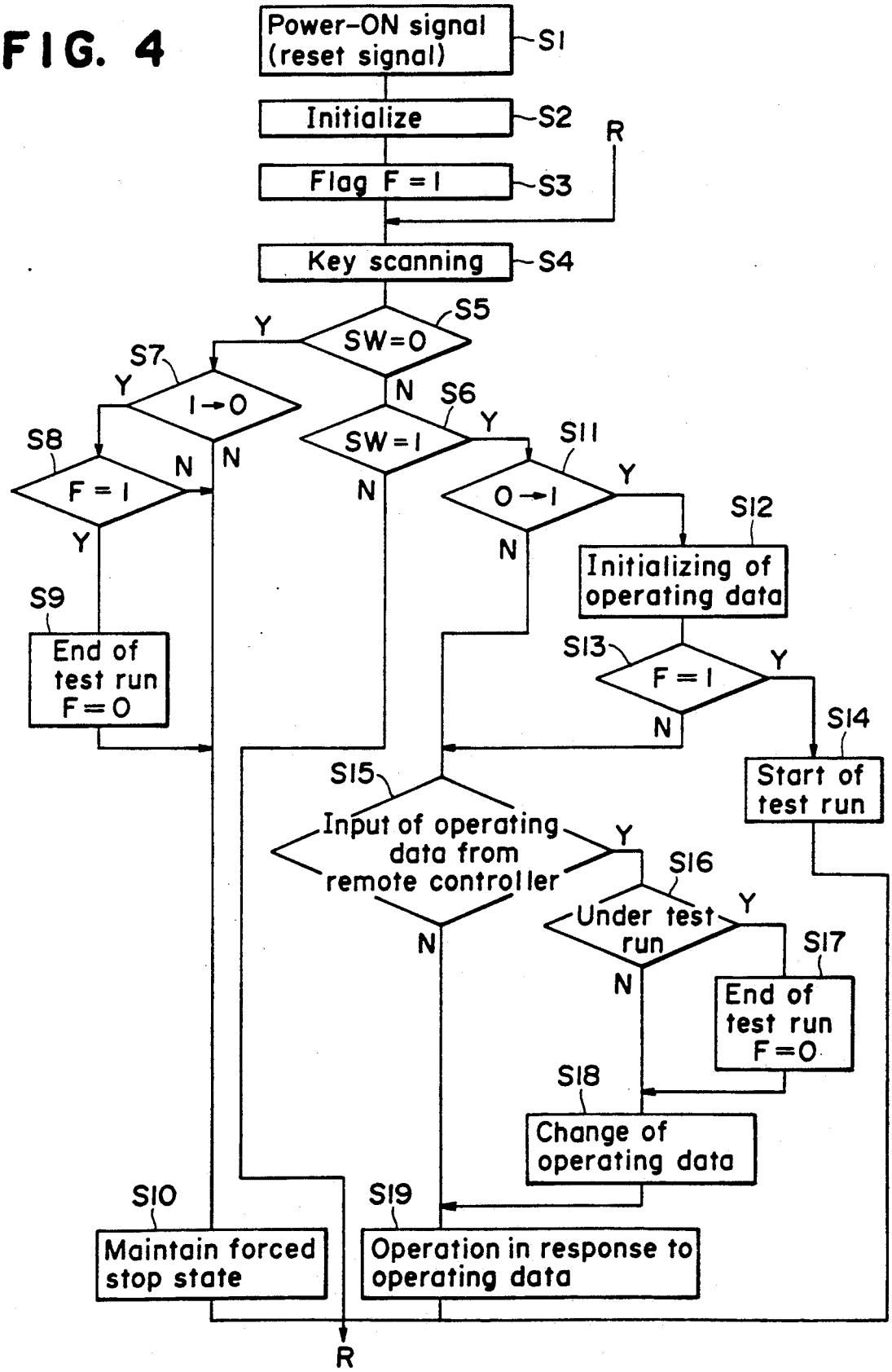
FIG. 4 is a flow-chart showing a main operation of a microprocessor shown in the electrical circuit diagram in FIG. 2.

FIG. 4 is a diagram showing the main operations of the microprocessor 12 shown in FIG. 2. In this diagram, first, when the power-ON signal (a reset signal to the terminal R of the microprocessor 12 shown in FIG. 2) is output in the step S1, the operations according to the following steps are carried out. In the step S2, initializing is performed. Namely, data such as the operating data are initialized and so forth. Next, a flag F is set to F=1 in the step S3. Subsequently, key scanning is performed in the step S4 and the result, that is, the position of the switch 8 is whether "0" or "1" is stored in the storage section. Subsequently, the flow shifts to the step S5 and the step S6, and, depending on whether the result of scanning in the step S4 is "0" or "1", the flow shifts to the step S7 or the step S11. In the steps S7, a determination is made as to whether or not the switch S8 is in a 1→0 position, (there are three types of positions including 1→0, 0→0 and previous time →0). "No previous time→0" means a position which occurs when the microprocessor 12 performs the key scanning in the first place after it is reset. When 1→0 is detected in the step S7, the flow, shifts to the step S8 where a determination is made as to whether or not the flag F is set to F=1. When F=1, the flag F is set F=0 after the ending of the test run in the step S9, and thereafter, the flow shifts to the step S10 to hold the air conditioner in the forced stop. Consequently, by passing through the steps S7-S9, the microprocessor 12 performs the first effective scanning after the reset. As a result, when the switch 8 is set to the position "0" or set to 0→0 (the switch is left unchanged from "0"), if the switch 8 is set to 1→0 and F=0, then the operation of the air conditioner is maintained in the stopped state, and, if the switch 8 is set to 1→0 and F=1, then the currently continuing test run is stopped, the flag is set to F=0, and thereafter, the air conditioner is held in the stopped state.

When the switch 8 is set to the position "1" in the step S6, subsequently, in the step S11, a determination is made as to whether or not this position has changed to 0→1. (There are three types of positions including 0→1, 1→1 and no previous time→0). The position "no previous time→1" means a position which takes place when the microprocessor 12 performs the key scanning in the first place after it is reset. When 0→1 is detected in the step S11, the operating data is initialized in the step S12, and thereafter, it is further determined whether or not F=1 in the step S13. If F=1, then the test run is started in step S14. The test run is the operation during which the running of the compressor, i.e. the operation of a refrigerating cycle is forcibly performed regardless of the temperature in the room to be air-conditioned and a set temperature, so that the identification of the operation can be easily performed when the air conditioner is installed. When F=1 is not satisfied in the step S13, the flow shifts to the step S15. In this step, a determination is made as to whether or not an input of an operation data is received from the remote controller 7. When the input of the operation data is received in the step S15, the flow shifts to the steps S16-S18. In these steps, while the test run is performed, F=0 is set to end the test run, thereupon, the data of the operating data stored in the storage section are changed in response to the input of the operating data thus received, and thereafter, the flow shifts to the step S19 and the air conditioner is operated in response to the operating data stored in the storage section. Consequently, by carrying out these steps S11-S19, the switch 8 is set to 0→1, if F=1, the test run is performed, and, if F=0, the air conditioner is operated in response to the initialized operation data. When an input of the operating data (signals obtained by the operation of the remote controller, e.g. operation/stop of the air conditioner, a room temperature set value, an air speed set value and so forth) is received, the operating data stored in the storage section is replaced by this new operating data, and further, at this time, if the air conditioner is in the test run, then this test run is ended and flag F is set to F=0. Thereafter, the operation in response to this operating data is carried out.

When the operation shown in the diagram of FIG. 4 is started in the state where the position of the switch 8 is in "1", under the supposition that the AC power source is recovered from current stoppage, the initialized value of the operating data (setting in the step S2) may be set to the stop-state of the operation of the air conditioner, that is, a state of waiting for an operation data from the remote controller. At this time, the initializing of the operating data in the step S12 is set to "operation being started".

According to the control device for the air conditioner having the above arrangement, first, when AC power source is supplied to the air conditioner when the switch 8 is in "1" at the time the air conditioner is installed, if the DC output of the power source 32 shown in FIG. 2 exceeds a predetermined voltage, then a reset signal is supplied to the terminal R of the microprocessor 12, whereby the operation shown in the diagram of FIG. 4 is started. This is the state in which the air conditioner is stopped, that is, the state of waiting for an operation data. Consequently, when the remote controller 7 is operated, the operation of the air conditioner is started. If the remote controller 7 is lost or unavailable for some reasons in the stopped state of the air conditioner, then the switch 8 is operated to proceed in the order of 1→0→1, so that the air conditioner is stopped once, and subsequently, the operation is automatically started. The operating data at this time is the operating data initialized in the step S12 as shown in FIG. 4.

Next, when the AC power source is supplied to the air conditioner when the position of the switch 8 is "0", the operation of the microprocessor 12 is started, no display of "test run" is needed, and troubles caused by the presence of this display and the start of the test run by erroneous operation can be avoided.

As has been described hereinabove, in the control device for an air conditioner, the microprocessor starts the scanning of the position of the switch and receives receiving circuit when the electrical power is supplied from the power source. Then, the microprocessor carrys out the operation of the air conditioner in response to the operating data when the switch is in the first position after the first effective scanning, and maintains the operation of the air conditioner in the forcibly stopped state when the switch is in the second position. Then, the microprocessor carries out the test run during which the air conditioner is forcibly and continously operated when the microprocessor has determined that the switch is changed from the second position to the first position, and ends the test run and starts the operation of the air conditioner in response to the operating data from the receiving circuit when the input of the operating data is received from the receiving circuit. Thus, the test run is performed when the switch is switched to the first position from the second position which has been taken at the time of initially supplying to the air conditioner.

This first position is the position to be set during the normal operation of the air conditioner, whereby, for the user of the air conditioner, it is not easily determined that the air conditioner is in the state of the test run because of no special display of the test run, and the user interprets it as the normal operation. Namely, the starting and its identifying of the test run, which can be easily performed by the installment personnel and the person in charge of service and inspection of the air conditioner, is not available to general users and, accordingly, it is avoidable that the user has a chance to mistakenly effect the test run. Further, there is no case that the display of the test run is left unchanged and therefore the feeling of unusualness to the display can be avoided.

Furthermore, even when the servicing and installation personnel of the air conditioner has forgotten the ending operation of the test run, the user can automatically end the test run by operating the remote controller to perform the normal operation since the test run can be ended by the input of the operating data. Accordingly, damage and trouble of the air conditioner caused by the forgotten ending of the test run can be avoided. In this case, the display of the switch is in the state of the normal operation, so that the user does not have the feeling of unusualness and no mistaken operation is performed.

Furthermore, even when the microprocessor determines from the result of scanning that the position of the switch is changed from the first position to the second position, the air conditioner can be stopped after identifying the operation at the time of installation of the air conditioner by ending the test run. In this case, the test run can be ended without using the remote controller.

What is claimed is:

1. A control device for operating a test run of an air conditioner, with a wireless remote controller for transmitting operating data to said air conditioner, having:

a receiving circuit for receiving the operating data;

a switching means having at least two switching positions;

a microprocessor for operating said air conditioner in response to the operating data received by said receiving circuit;

a power source for supplying electrical power to said microprocessor;

said microprocessor scanning a position of said switching means and thereafter inputting the operating data from said receiving circuit during the time when the electrical power is supplied to said microprocessor;

wherein said microprocessor comprises:

a first means for starting an operation of said air conditioner in response to the operating data when said switching means is in a first position;

a second means for maintaining the operation of said air conditioner in a forced stopping state so as to ignore the operating data when said switching means is in a second position;

a third means for starting said test run of said air conditioner when said switching means is changed first from the second position to the first position after said switching means is placed in the second position thereof by an initial and effective scanning of said microprocessor; and a fourth means for changing from the test run and carrying out the operation of said air conditioner in response to the operating date when said receiving circuit receives the operating data from said wireless remote controller during the test run of said air conditioner.

2. A control device according to claim 1, wherein said microprocessor comprises further a fifth means for changing the operation of said air conditioner from the test run to the forced stop state and for maintaining said operation in said forced stop state when said switching means is changed from the first position to the second position during the test run of said air conditioner.

* * * * *